US005920913A

United States Patent [19]

Brandon et al.

[11] Patent Number: 5,920,913

[45] Date of Patent: Jul. 13, 1999

[54] COMBINATION BASEBALL CAP AND FIELDER'S GLOVE

[76] Inventors: Ronald Earl Brandon, 652 Jubilee St., Melbourne, Fla. 32940; Douglas Ronald Brandon, 950 So. Ogden St., Denver, Colo. 80209

[21] Appl. No.: 09/186,103

[22] Filed: Nov. 5, 1998

[51] Int. Cl.[6] ..... A42B 1/06

[52] U.S. Cl. ..... 2/209.12; 2/19; 2/195.1

[58] Field of Search ..... 2/19, 173.5, 195.1, 2/209.12, 175.1; D2/869, 872

[56] References Cited

U.S. PATENT DOCUMENTS

| | | | |
|---|---|---|---|
| 2,874,387 | 2/1959 | Bannister et al. | 2/195 |
| 3,766,565 | 10/1973 | Cozzens | 2/200 |
| 4,628,543 | 12/1986 | Hunt | 2/19 |
| 4,768,232 | 9/1988 | Villalobos | 2/19 |
| 4,829,600 | 5/1989 | Courtney | 2/19 |
| 5,487,191 | 1/1996 | Ridley | 2/195.1 |
| 5,542,129 | 8/1996 | Munoz | 2/209.12 |
| 5,742,944 | 4/1998 | Pfefferman | 2/209.12 |
| 5,815,841 | 10/1998 | Spangrud | 2/195.1 |

*Primary Examiner*—Diana L. Oleksa
*Attorney, Agent, or Firm*—Ross, Ross & Flavin

[57] ABSTRACT

A combination baseball cap and fielder's glove having a concave crown of appropriate size to fit the head of a wearer with a brim attached to a forward edge of the crown and extending horizontally outwardly therefrom and having finger openings extending through the brim of appropriate size to allow the fingers of the wearer to extend therethrough for firmly grasping the brim and enabling the cap to be used as a glove when removed from the wearer's head, with the crown serving to catch and hold a baseball.

8 Claims, 2 Drawing Sheets

COMBINATION BASEBALL CAP AND FIELDER'S GLOVE

BACKGROUND OF THE INVENTION

1. Field of the Invention

The present invention relates to baseball caps and gloves and in particular to an improved combination cap and glove for increasing the enjoyment and safety of the fans who are observing the games.

2. Description of the Prior Art

Baseball fans sit in a rather dangerous location, where high velocity baseballs can injure those not prepared to catch or deflect the balls. A few fans bring regular baseball gloves to catch such balls; but the vast majority of the fans are unprepared to catch a baseball and are relatively unprotected.

Beyond protection, it is the desire of most fans to catch a baseball which can be kept as a valued souvenir. In addition, catching a ball with one's bare hands can cause a painful injury.

A large number of fans wear baseball hats which can be used in an attempt to catch a baseball by grasping the brim. Unfortunately most caps are structurally unsuitable to capture a ball traveling at high velocity, and the brim of the cap is likely to slip from the hand of the fans when the ball strikes into the crown portion of the cap.

It would be desirable to make the cap a better ball catcher while retaining the benefits of a head covering. That is the purpose of this invention.

BRIEF SUMMARY OF THE INVENTION

Accordingly it is an object of the present invention to provide a cap having a brim which can be firmly gripped by the hand of the wearer.

An additional object is to provide an improved pocket in the crown of the cap for capturing a ball.

Still another object is to provide a cap with improved strength to prevent tearing when impacted by a ball.

These and other objects are achieved by the present invention which provides a cap having finger holes in the brim which can be gripped by the fingers for assuring a firm grip.

In addition,the crown portion of the cap includes a rear pocket to help capture and retain a baseball.

The cap of the invention can be fabricated from leather, plastic or fabric,or a combination thereof,to provide headgear which is comfortable and sturdy and will retain its shape.

DETAILED DESCRIPTION OF THE INVENTION

Figure 1:
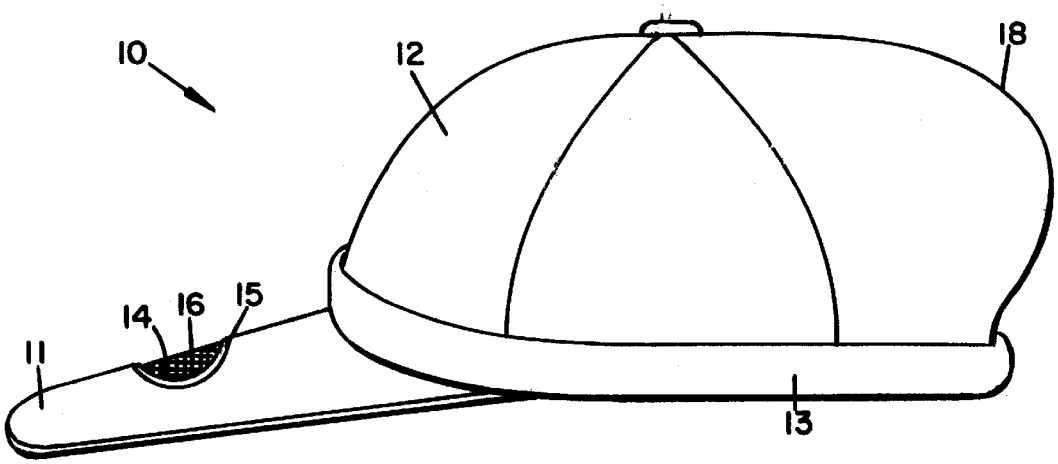
FIG. 1 is a side elevational view of a combination baseball cap and fielder's glove embodying a preferred form of the invention.
Figure 2:
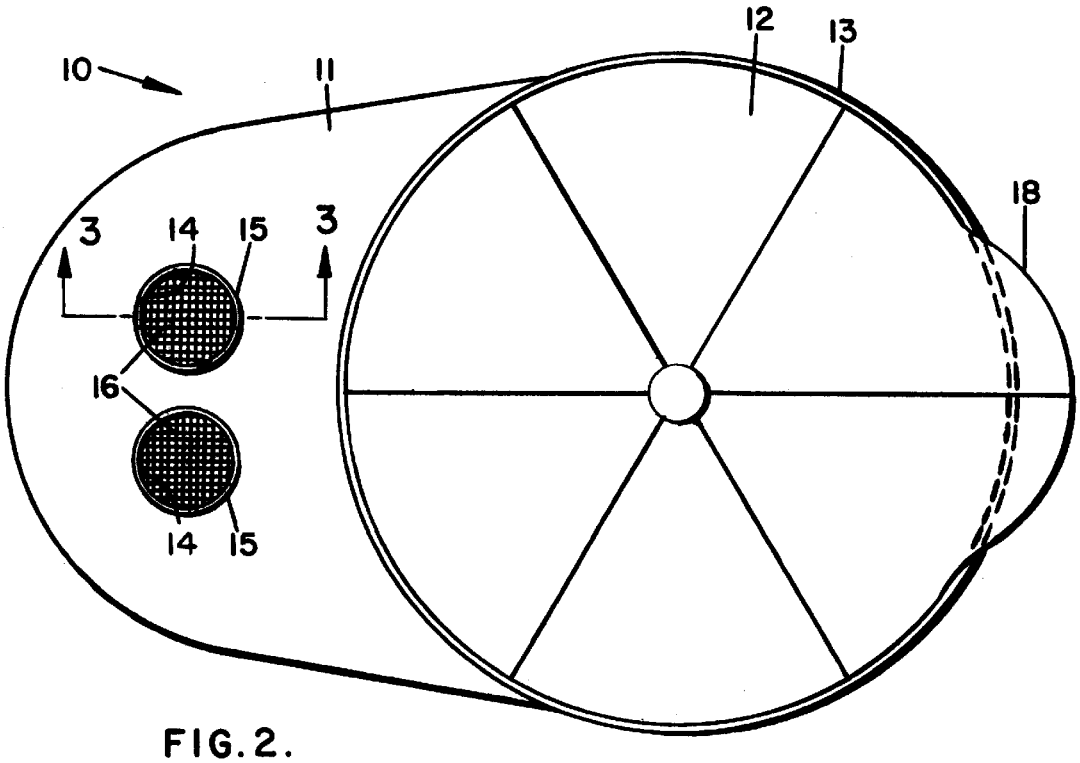
FIG. 2 is a top plan view of the combination baseball cap and fielder's glove of FIG. 1.

With detailed reference to the drawing, a combination baseball cap and fielder's glove embodying the invention is generally indicated by 10 and includes a brim 11, a crown 12 and a circumferential strap 13 encircling the base of the crown of suitable size to snugly encircle a wearer's head.

A pair of transversely spaced, aligned openings 14 are provided approximately centrally of the brim and extend entirely through the thickness of brim 11.

Additional finger openings may be provided as desired.

Openings 14 are of appropriate size and spacing to accommodate two or more fingers of the cap wearer, with their edges being chamferred or rounded as at 15 so as not to cause discomfort or harm to the fingers when catching a ball.

A flap 16 of springy, flexible fabric material is secured to brim 11 under finger openings 14 as by gluing or sewing as indicated at 17.

Flap 16 can be in the form of a single piece under-lying both finger openings 14; or it can be in the form of individual pieces underlying each finger opening.

Figure 3:
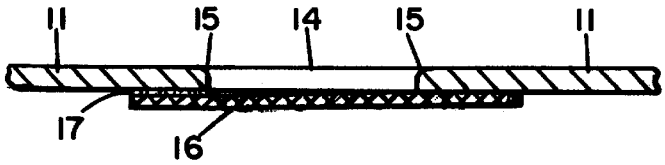
FIG. 3 is an enlarged, fragmentary cross sectional view taken along line 3—3 of FIG. 2.

Gluing or sewing 17 can be provided only at a portion of the side edge of each opening 14, as shown in FIG. 3, to allow easy deflection of the other side edge of the flap, thereby permitting free passage through openings 14 of the fingers of a user for gripping brim 11, with the flap automatically returning to its original position underlying openings 14 when the fingers are withdrawn.

Figure 4:
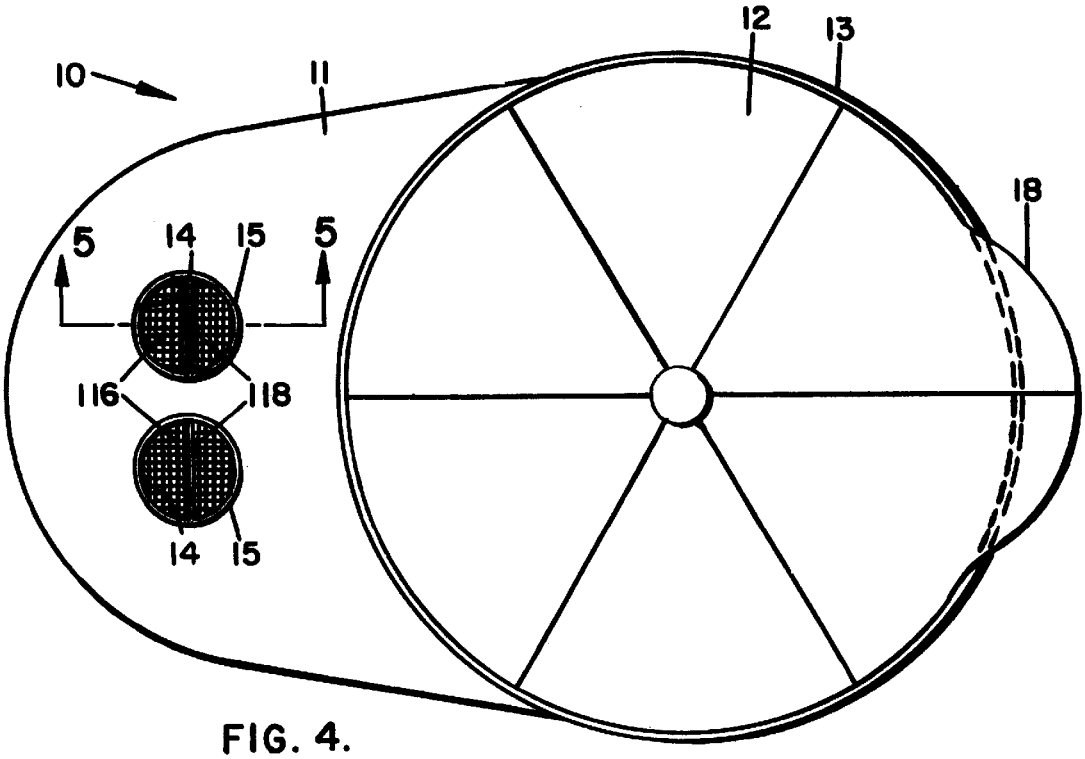
FIG. 4 is a fragmentary top plan view of a combination baseball cap and fielder's glove embodying a modified form of the invention.
Figure 5:
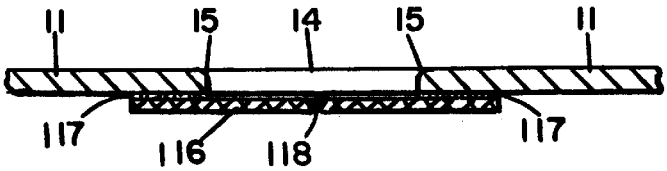
FIG. 5 is an enlarged, fragmentary cross sectional view taken along line 5—5 of FIG. 4.

Alternatively, and as shown in a modified form in FIGS. 4 and 5, a flap 116 of springy, flexible fabric material is secured under each finger opening 14 as by gluing or sewing as at 117 forming a ring completely around each finger opening 14 with the flap being split down the middle as at 118 to permit easy passage of a user's fingers through openings 14 for gripping brim 11.

Flaps 16 and 116 are sufficiently opaque to block the passage of rays of sunlight through finger openings 14 which might otherwise blind the wearer and are sufficiently flexible to permit the insertion of the wearer's fingers while returning to normal position when the fingers are withdrawn from the openings.

The rear of crown 12 of cap 10 is enlarged or extended outwardly to form an inwardly-facing semi-circular pocket 18 of appropriate size and configuration to hold a baseball.

When in a ball-catching mode, the baseball fan places two fingers into openings 14 with the thumb over the front end of the brim; the cap is then removed from his head and rotated so that the open concave crown faces an approaching baseball.

Strap 13 is selected from a material such as leather which will be sufficiently strong to reinforce the crown to stop a baseball traveling at a high rate of speed, while being sufficiently soft and yielding so that the cap fits comfortably on the head of a wearer, while maintaining crown 12 in a near circular, open condition.

Brim 11 is fabricated from a reasonably strong material such as leather or plastic to keep its shape and not tear or rupture when the cap is used to catch a fast-moving baseball.

Brim 11 and crown 12 are securely fastened to strap 13 as by stitching or the like, not shown.

Brim 11 may be increased in length from that shown in the drawing to increase the reach or range of the cap for ball catching.

A printed or sewn pattern, not shown, may be provided on crown 12 to provide an illusion of a real baseball glove.

We claim:

1. A combination baseball cap and fielder's glove comprising:

a concave crown of appropriate size to fit the head of a wearer, a brim attached to a forward edge of the crown and extending horizontally outwardly therefrom, circular finger openings extending through the brim of appropriate size and configuration to allow the fingers of a wearer to extend therethrough for firmly grasping the brim and enabling the cap to be used as a glove when removed from the wearer's head, with the crown serving to catch and hold a baseball.

2. A combination baseball cap and fielder's glove according to claim 1, including an outwardly-extending, inwardly-facing pocket on a rear face of the crown for aiding in catching and retaining a baseball in the crown.

3. A combination baseball cap and fielder's glove according to claim 1, including a flexible flap fixed to the brim and covering the finger openings for blocking the passage of sun rays through the finger openings while permitting the passage of a user's fingers through the openings.

4. A combination baseball cap and fielder's glove according to claim 3, wherein the flexible flap is fixed to the brim at only a portion of a side edge of the finger openings.

5. A combination baseball cap and fielder's glove according to claim 3, wherein the flexible flap is fixed to the brim completely around the edges of the finger openings and is provided with a centrally located split for permitting the passage of a user's fingers through the openings.

6. A combination baseball cap and fielder's glove according to claim 1, including flexible flaps fixed to the brim, each flap covering a finger opening for blocking the passage of sun rays through the finger openings while permitting the passage of a user's fingers through the openings.

7. A combination baseball cap and fielder's glove according to claim 1, wherein there are a pair of aligned finger openings disposed approximately centrally of the brim.

8. A combination baseball cap and fielder's glove according to claim 1, including a decorative design on the crown simulating a baseball glove.

* * * * *